United States Patent [19]

Beck

[11] Patent Number: 4,795,044

[45] Date of Patent: Jan. 3, 1989

[54] TAMPER EVIDENT CLOSURE WITH SNAP-TYPE HINGE CAP

[75] Inventor: James M. Beck, Carol Stream, Ill.

[73] Assignee: Owens-Illinois Closure Inc., Toledo, Ohio

[21] Appl. No.: 184,306

[22] Filed: Apr. 21, 1988

[51] Int. Cl.[4] ..... B65D 47/06

[52] U.S. Cl. ..... 215/237; 222/153; 215/253

[58] Field of Search ..... 215/235, 237, 253; 222/153

[56] References Cited

U.S. PATENT DOCUMENTS 4,127,221 11/1978 Vere ..... 222/153

4,718,567 1/1988 La Vange ..... 215/216

*Primary Examiner*—George T. Hall

[57] ABSTRACT

A tamper evident closure with a snap-type hinge cap comprising a first part adapted to interengage with the open neck of a container and a second part forming a cap connected to the first part by an integral hinge. A first tamper indicating device is provided between the first part and the neck of the container. The first part includes a dispensing spout that is adapted to be closed by a portion of the second part. A second tamper evident strip in the form of a locking ring is connected by an integral hinge to one of the two parts and is adapted to be interposed between the two parts when the closure is closed with a portion extending beyond the periphery of the closure providing evidence that the closure has not been tampered with. In order to open the closure, the tamper evident strip must be torn away so that the second part can be opened. Tampering of the integral hinge of the two parts also provides an indication of tampering.

16 Claims, 4 Drawing Sheets

TAMPER EVIDENT CLOSURE WITH SNAP-TYPE HINGE CAP

This invention relates to closures with snap-type hinge caps.

BACKGROUND AND SUMMARY OF THE INVENTION

One common type of closure which has received extensive use is the closure known as the snap-type hinge cap which includes a first part adapted to interengage with the open neck of a container, a second part forming a cap and an integral hinge interconnecting the first and second parts. A typical closure of this type is shown in U.S. Pat. No. 4,638,916.

With the increase in emphasis on making packages tamper indicating or tamper evident, it may be required that that tamper evident feature be applied, if possible, to a closure with a snap-type hinge cap. The first part which interengages with the open neck of the container can be provided with tamper indicating devices such a shrink band or as shown in U.S. Pat. Nos. 4,378,893, 4,418,828, and 4,669,623.

However, as far as I am aware, no satisfactory tamper indicating construction has been provided for indicating tampering with respect to the first and second parts of such a closure.

Accordingly among the objectives of the present invention are to provide a tamper indicating closure and package of the snap-type hinge cap; which is simple and inexpensive; which can be readily applied; and which will provide effective tamper evident features.

In accordance with the invention, a tamper indicating device in the form of a locking ring is formed and connected by a integral hinge with either the first or second part of the closure and is adapted to be folded into position between the first and second part when the closure is first closed. Upon being closed, the locking ring will project beyond the periphery of the two parts and will provide an indication that the closure has not been tampered with. In order to provide access to the contents, the tear strip will need to be torn at the hinge line of the locking ring to the closure part.

DESCRIPTION

Figure 1:
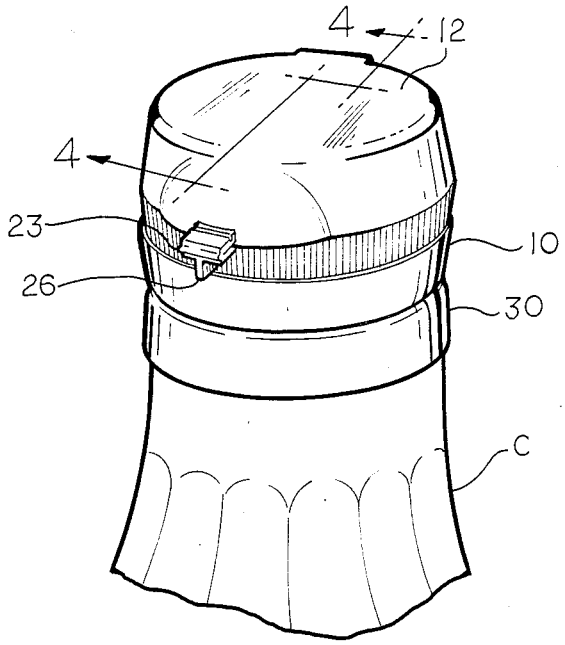
FIG. 1 is a fragmentary perspective view of a closure and container embodying the invention.

Referring to FIGS. 1–4, the closure embodying the invention is of the snap-type hinge variety comprising a first plastic part 10 including a base wall 10*a* and skirt 10*b* adapted to be engaged with the neck of a container C as by threads 11 and a second plastic part 12 or cap including a base wall 12*a* and skirt 12*b* connected to the first part 11 by an integral hinge 13. The first part 10 includes an axial spout 14 that is adapted to be closed by a complementary plug 15 on the second part 12 when the part 12 is moved into closed position. Such closures are well known in the art and shown in U.S. Pat. No. 4,638,916, which is incorporated herein by reference.

Figure 2:
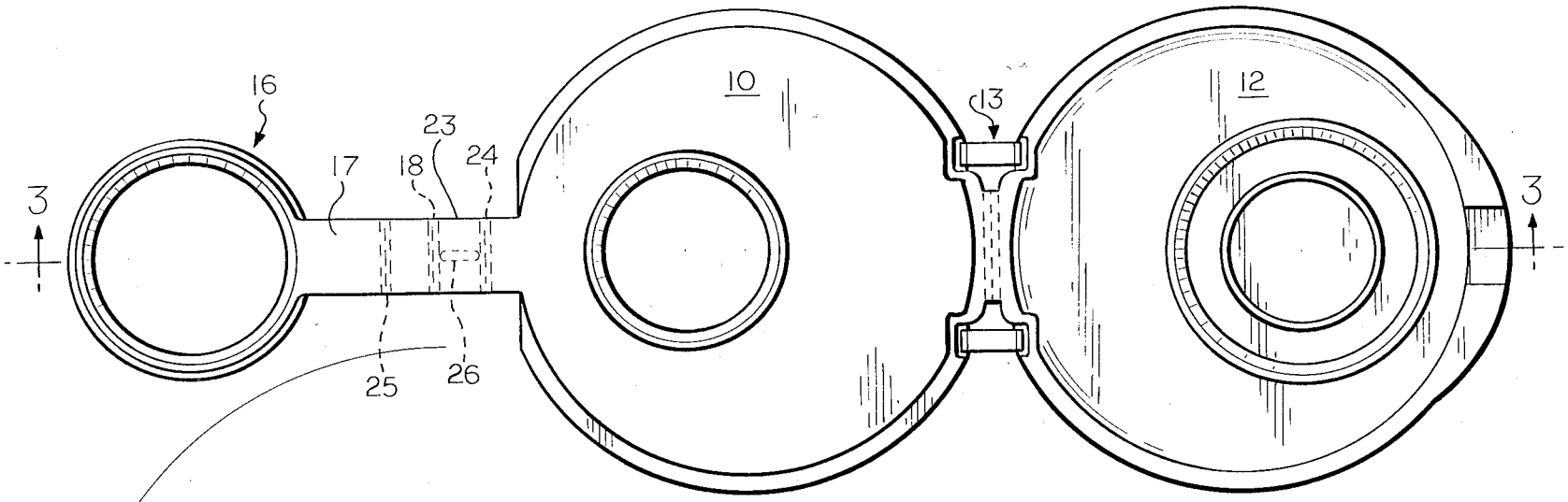
FIG. 2 is a plan view of the closure in open position.
Figure 3:
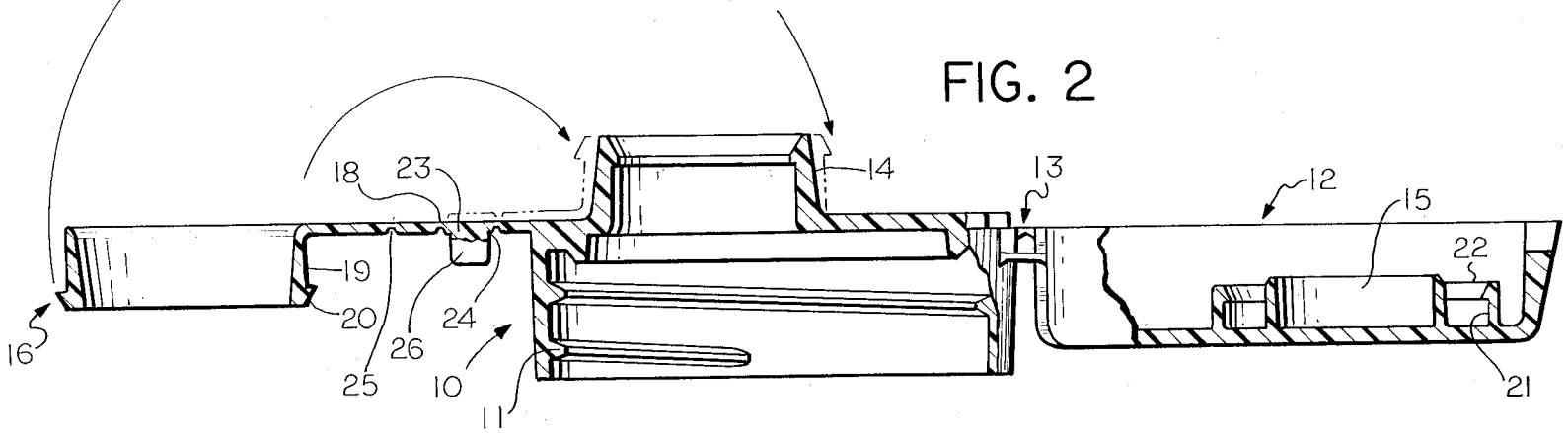
FIG. 3 is a sectional view taken along the line 3—3 in FIG. 2.

In accordance with the invention, a tamper indicating device in the form of a integral locking ring 16 is molded to one of the closure parts, shown in FIGS. 1–3 as being connected by an integral hinge 17 to first part 10.

The hinge 17 of locking ring 16 includes a fold line 18 such that the ring 16 may be folded about line 18 to bring ring 16 over spout 14. The ring 16 includes a circumferential wall 19 that extends axially from the ring 16 and has an external annular bead 20 thereon. Wall 19 telescopes over spout 14. The base 12*a* and part 12 includes a second axial wall 21 surrounding axially spaced radially outwardly from axial spout 15 which has an internal annular bead 22 that interengages the bead 20 to lock the second part 12 in closed position. The hinge 17 of locking ring 16 includes a tear strip 23 connected by weakened lines 24, 25 thereto. Tear strip 23 includes an axially extending tab 26 extending from the strip 23 for grasping the strip 23 so that it can be severed.

After filling of the container, a closure is threaded on the container. Prior to this, the locking ring 16 is preferably folded to the position shown in FIG. 4.

After the closure is threaded on the container, a tamper indicating means is provided between the part 10 and the neck of the container, herein shown as a shrink band 30. Alternatively, other mechanical tamper indicating devices may be used as shown, for example, U.S. Pat. Nos. 4,378,893, 4,418,828, and 4,669,623, which are incorporated herein by reference.

Figure 4:
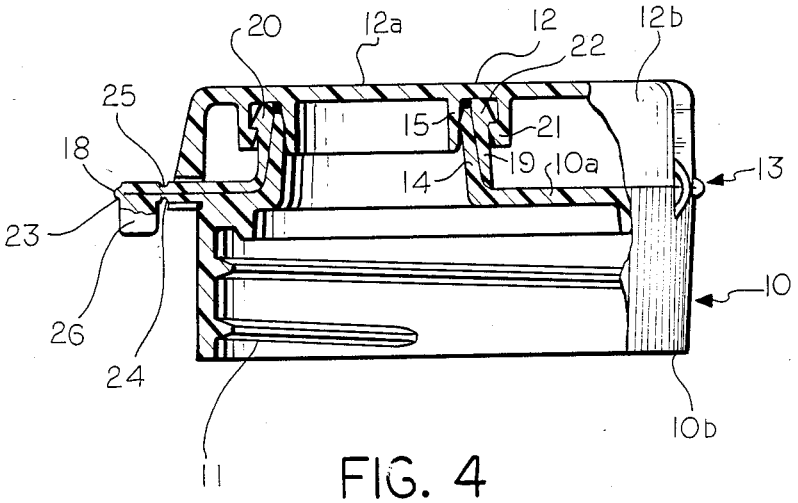
FIG. 4 is a fragmentary sectional view taken along line 4—4 in FIG. 1.

As shown in FIG. 4, when the closure is applied to the container, the portion 23 of the hinge 17 projects beyond the periphery of the closure giving a visual indication that the contents have not been tampered with. If this is torn, then a user knows that the package has been tampered with. In order to provide access to the contents, the portion 23 must be torn permitting the closure part 12 together with the locking ring 16 to be swung upwardly away from the part 10.

Figure 5:
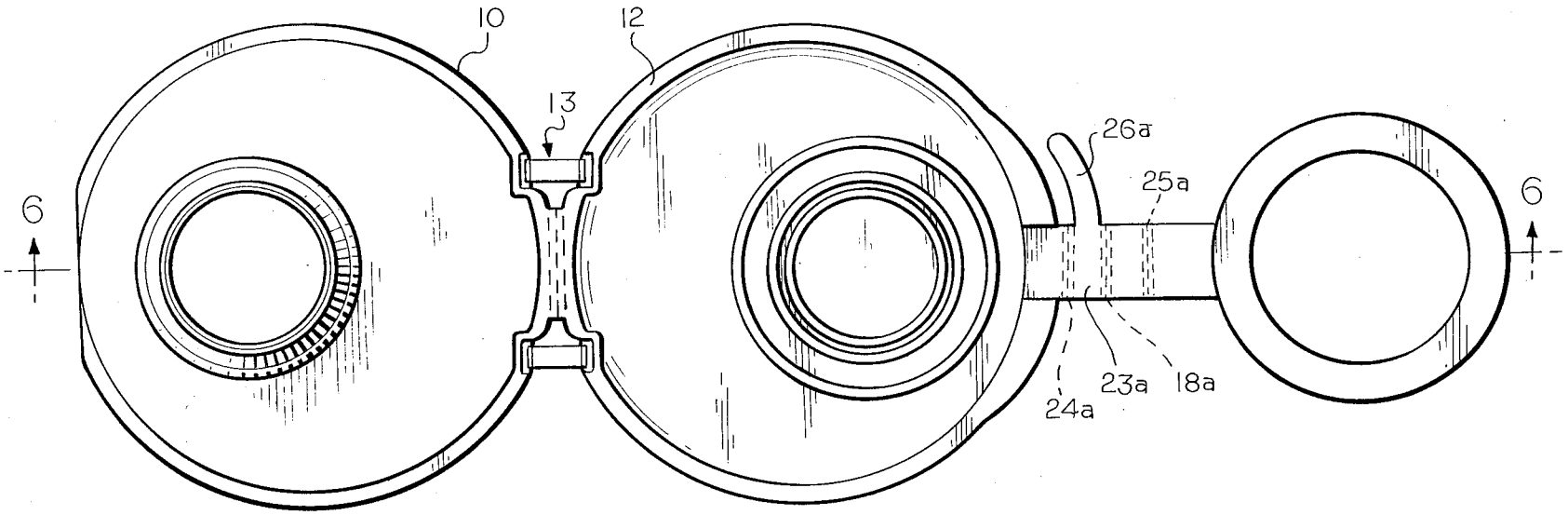
FIG. 5 is a plan view of a modified form of closure.
Figure 7:
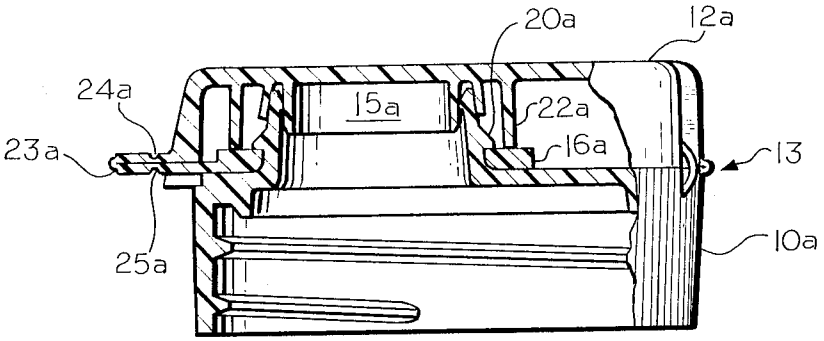
FIG. 7 is a view showing the modified closure in closed position.
Figure 6:
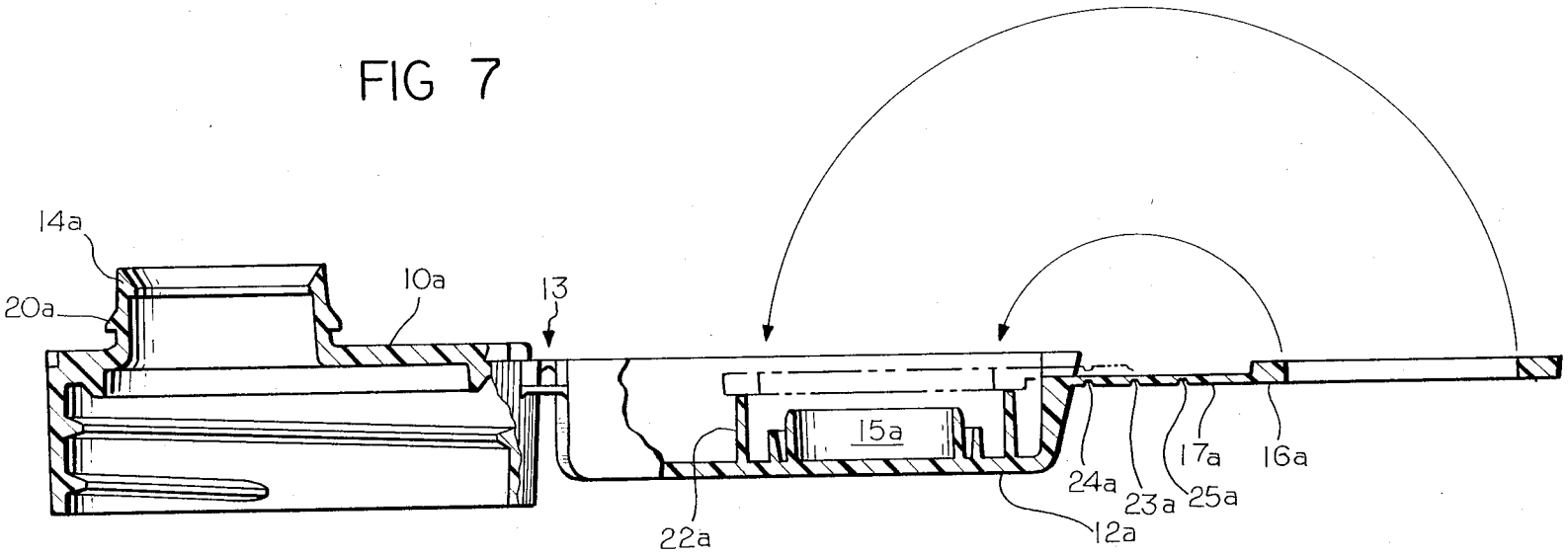
FIG. 6 is a longitudinal sectional view taken along the line 6—6 in FIG. 5.

In the form shown in FIGS. 5–7, the locking ring 16*a* is hinged to the part 12 rather than the part 10. In all other respects, the closure is the same.

In the interest of clarity, the parts are provided with the same reference numerals with the suffix a. Tab 26*a* in this form extends laterally from hinge 17*a*.

Ring 16*a* functions to engage directly an external annular bead 20*a* on the axial spout 14*a* and axial wall 22*a* on part 12*a* engages the ring 16*a* (FIG. 7).

It can thus be seen that there has been provided a tamper indicating closure and package of the snap-type hinge cap, which is simple and inexpensive, which can be readily applied, and which will provide effective tamper evident features.

I claim:

1. A tamper evident closure with a snap-type hinge cap comprising a first part adapted to interengage with the open neck of a container, a second part forming a cap connected to the first part by an integral hinge, said first part including a dispensing spout that is adapted to be closed by a portion of the second part, a tamper indicating ring connected by an integral hinge to one of the two parts and adapted to be interposed between the two parts and engage said spout when the closure is closed with a portion extending beyond the periphery of the closure providing evidence that the closure has not been tampered with.

2. The closure set forth in claim 1 wherein said tamper evident ring includes a portion which must be torn away so that the second part can be opened relative to the first part.

3. The closure set forth in claim 2 including interengaging means between said tamper indicating ring and at least one said part operable to prevent opening of said first part relative to said second part.

4. The closure set forth in claim 3 wherein said tamper indicating ring is on said first part and said interengaging means comprises an internal annular bead on said second part, said ring having an external bead thereon adapted to engage said internal annular bead.

5. The closure set forth in claim 3 wherein said tamper indicating ring is on said second part and said interengaging means comprises an external bead on said axial spout, said ring engaged said external bead.

6. The closure set forth in claim 5 wherein said second part includes an annular wall adapted to engage said ring axially when the second part is closed.

7. The closure set forth in claim 3 wherein said integral hinge of said ring includes a tear strip.

8. The closure set forth in claim 7 including a tab on said tear strip for grasping said tear strip.

9. A tamper evident packing comprising a container having a neck, a closure with a snap-type hinge cap, said closure comprising a first part adapted to interengage with the open neck of the container, a second part forming a cap connected to the first part by an integral hinge, said first part including a dispensing spout that is adapted to be closed by a portion of the second part, first tamper evident means between the first part and the neck of the container, second tamper evident means including a tamper indicating ring connected by an integral hinge to one of the two parts and adapted to be interposed between the two parts and engage said spout when the closure is closed within a portion extending beyond the periphery of the closure providing evidence that the closure has not been tampered with.

10. The package set forth in claim 9 wherein said tamper evident ring includes a portion which must be torn away so that the second part can be opened relative to the first part.

11. The package set forth in claim 10 including interengaging means between said tamper indicating ring and at least one said part operable to prevent opening of said first part relative to said second part.

12. The package set forth in claim 11 wherein said tamper indicating ring is on said first part and said interengaging means comprises an internal annular bead on said second part, said ring having an external bead thereon adapted to engage said internal annular bead.

13. The package set forth in claim 11 wherein said tamper indicating ring is on said second part and said interengaging means comprises an external bead on said axial spout, said ring engaged said external bead.

14. The package set forth in claim 13 wherein said second part includes an annular wall adapted to engage said ring axially when the second part is closed.

15. The closure set forth in claim 11 wherein said integral hinge of said ring includes a tear strip.

16. The closure set forth in claim 15 including a tab on said tear strip for grasping said tear strip.

* * * * *